US005862577A

United States Patent [19]

Zimmerman et al.

[11] Patent Number: 5,862,577

[45] Date of Patent: Jan. 26, 1999

[54] SNAP RING INSTALLATION TOOL

[75] Inventors: Arthur B. Zimmerman, Huntsville; George H. Acker, Jr., Union Grove, both of Ala.

[73] Assignee: Dana Corporation, Toledo, Ohio

[21] Appl. No.: 802,590

[22] Filed: Feb. 19, 1997

[51] Int. Cl.[6] ..... B25B 27/14

[52] U.S. Cl. ..... 29/229

[58] Field of Search ..... 29/426.6, 229, 29/222, 223, 224, 235, 242, 280, 282; 269/48.1

[56] References Cited

U.S. PATENT DOCUMENTS

| | | | |
|---|---|---|---|
| 1,049,173 | 12/1912 | Turek . | |
| 2,010,258 | 8/1935 | Forbes . | |
| 2,158,527 | 5/1939 | Rose . | |
| 2,380,068 | 7/1945 | Patton . | |
| 3,479,722 | 11/1969 | Maness | 29/280 |
| 3,654,686 | 4/1972 | McFarland et al. | 29/280 |
| 4,724,608 | 2/1988 | Parrott | 29/282 |
| 5,347,697 | 9/1994 | Stallings | 29/280 |

*Primary Examiner*—Robert C. Watson
*Attorney, Agent, or Firm*—Millen, White, Zelano & Branigan, P.C.

[57] ABSTRACT

A tool is provided for ensuring that a snap ring fitted within an internally opening groove in a cylinder, such as a hydraulic cylinder, is properly seated within the groove. The tool includes a rim defining a radial shoulder and an axial projecting portion. The radial shoulder engages the radial surface of the snap ring to press the snap ring axially against an opposing radial shoulder within the cylinder to help flatten and align the snap ring while the axially projecting portion extends through the snap ring. A handle is mounted on the hub and engages inner ends of radially extending spokes, while a coil spring biases the handle outwardly from the hub to keep the spokes normally withdrawn. Upon pressing the handle axially against the bias of the coil spring, the spokes extend radially to engage the inner periphery of the snap ring to thereby shove the snap ring home within the groove. Upon pulling the handle, the spokes retract out of engagement with the snap ring and the tool is withdrawn from within the snap ring and hydraulic cylinder.

8 Claims, 2 Drawing Sheets

SNAP RING INSTALLATION TOOL

FIELD OF THE INVENTION

The present invention relates to snap ring installation tools. More particularly, the present invention relates to snap ring installation tools useful when installing snap rings in cylinders, for example, hydraulic cylinders.

BACKGROUND OF THE INVENTION

Snap rings are used for many purposes in mechanical devices. One use is in cylinders employed in hydraulic devices and systems. In accordance with one arrangement, a hydraulic cylinder has an internal annular groove disposed a slight distance in from an end surface. The groove receives spit snap rings in a relatively high tolerance fit which results frequently in the rings not readily snapping into place. The snap rings are used as mechanical stops for pistons slidably received in the cylinders. If the snap ring is not properly seated within the annular groove, then a defective assembly occurs in which there is a risk that the piston may dislodge the ring during the operation of the device. During assembly, it is not always easy to discern whether the snap ring is properly seated because the snap ring is installed inside of the cylinder, making visual inspection difficult.

SUMMARY OF THE INVENTION

In view of the aforementioned difficulties, it is a feature of the present invention to provide a new and improved device for ensuring proper seating of snap rings.

The present invention is directed to an assembly tool for ensuring the proper placement of a snap ring in an annular groove in a cylinder wall, wherein the snap ring has an inner periphery, an outer periphery, a first radial surface and a second radial surface, and wherein the tool comprises a rim, a plurality of radially projecting fingers and a handle.

The rim has a step therein defining a radially extending shoulder and an axially projecting portion, wherein the radially extending shoulder is adapted to engage the first radial surface of the snap ring and the axially projecting portion is adapted to seat within the snap ring adjacent the inner periphery thereof. The radially projecting fingers extend through the axially projecting portion of the rim and have outer portions. The handle urges the fingers radially outwardly with respect to the hub and causes the outer portions to engage the inner periphery of the snap ring to urge the snap ring to seat within the inner annular groove of the cylinder.

In a further aspect, a spring urges the handle axially outward with respect to the rim so that the fingers are normally biased out of the contact with the inner periphery of the snap ring.

In still a further aspect, a flange extends radially from the rim and is adapted to engage an end of the cylinder wall at a location proximate, but spaced from, the annular grooves.

In another aspect, the fingers form portions of radially extending spokes which have one end seated within a coupling element of the handle.

In still another aspect, the handle includes a grip which is in the form of a loop for facilitating pressing the handle against the bias of the spring and for facilitating pulling the tool out of the snap ring and cylindrical wall.

In each of the aspects of the invention, the tool may be configured and dimensioned for use with a hydraulic cylinder in which the snap ring is used as a stop for a piston.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
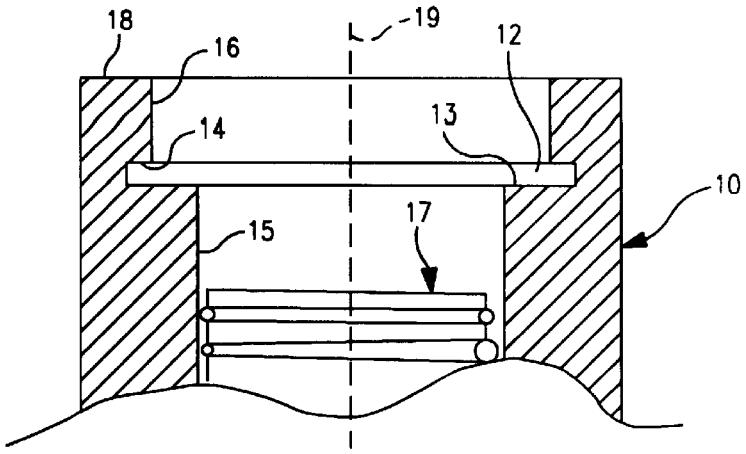
FIG. 1 is a side elevation of a hydraulic cylinder having an annular internal groove therein for receiving a snap ring.

Referring now to FIG. 1, there is shown a hydraulic cylinder 10 having an internal annular groove 12 disposed just outboard of a shoulder 13. The shoulder 13 forms the back surface of the groove 12 and is opposed by a front surface 14 of the groove. The shoulder 13 also divides the cylinder 10 into a relatively small diameter wall portion 15 and a relatively large diameter wall portion 16. A piston 17 reciprocates in the relatively small diameter portion 15 of the hydraulic cylinder 10. The annular shoulder 13 and the internal annular groove 12 both extend radially in a direction parallel to the end face 18 of the cylinder 10 and are both coaxial with the cylinder about the axis 19 of the cylinder.

Figure 2:
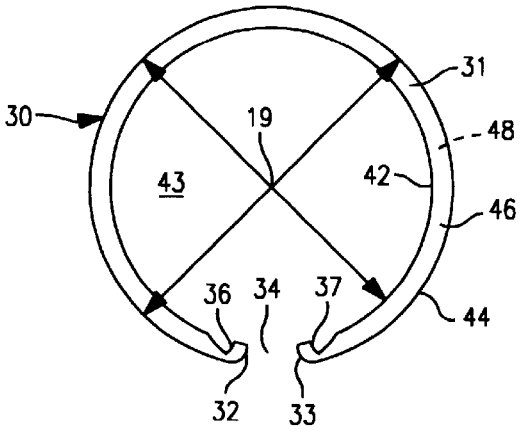
FIG. 2 is a top view of a snap ring which is received in the internal annular groove of the hydraulic cylinder of FIG. 1.

Referring now to FIG. 2, there is shown a snap ring 30 configured for seating within the annular groove 12 of FIG. 1. Snap ring 30 is comprised of a flat steel band 31 having ends 32 and 33 separated by a gap 34. Adjacent the gap 34 are notches 36 and 37 which are engaged by an installation tool (not shown) in order to reduce the diameter of the flat steel band 31 by squeezing the ends 32 and 33 together. When the snap ring 30 is thus constricted, it clears the relatively large diameter wall portion 16 in the bore of the cylinder 10 so that the snap ring 30 can be pushed axially into the cylinder until it abuts the shoulder 13. Upon releasing the notches 36 and 37 from the installation tool (not shown), the snap ring 30 expands presumably to seat within the internal annular groove 12.

The snap ring 30 has inner peripheral wall 42 defining an enclosed area 43 and an outer peripheral wall 44, as well as an outwardly facing, first radial surface 46 and an inwardly facing, second radial surface 48. The surfaces 46 and 48 are flat surfaces which extend parallel to one another. With some applications, the surfaces 36 and 48 have fairly close tolerances with respect to the shoulder 13 and front surface 14 of the groove 12 so that the snap ring 30 does not necessarily readily seat properly within the groove 12 upon releasing the notches 36 and 37 from the insertion tool (not shown). This is aggravated when the band 31 of the snap ring 30 has a slight twist so that the surfaces 46 and 48 are not flat.

Figure 4:
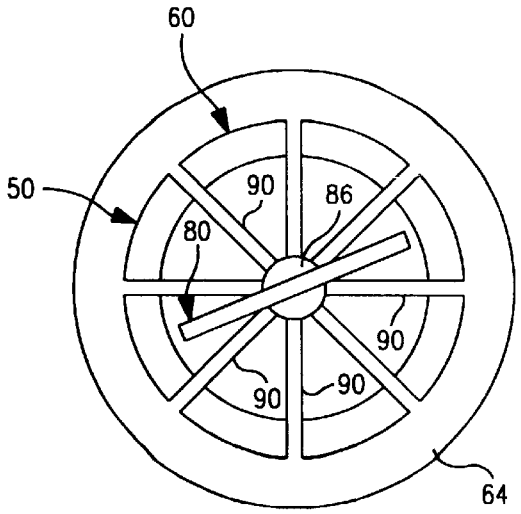
FIG. 4 is a top view of the tool shown in FIG. 3.
Figure 3:
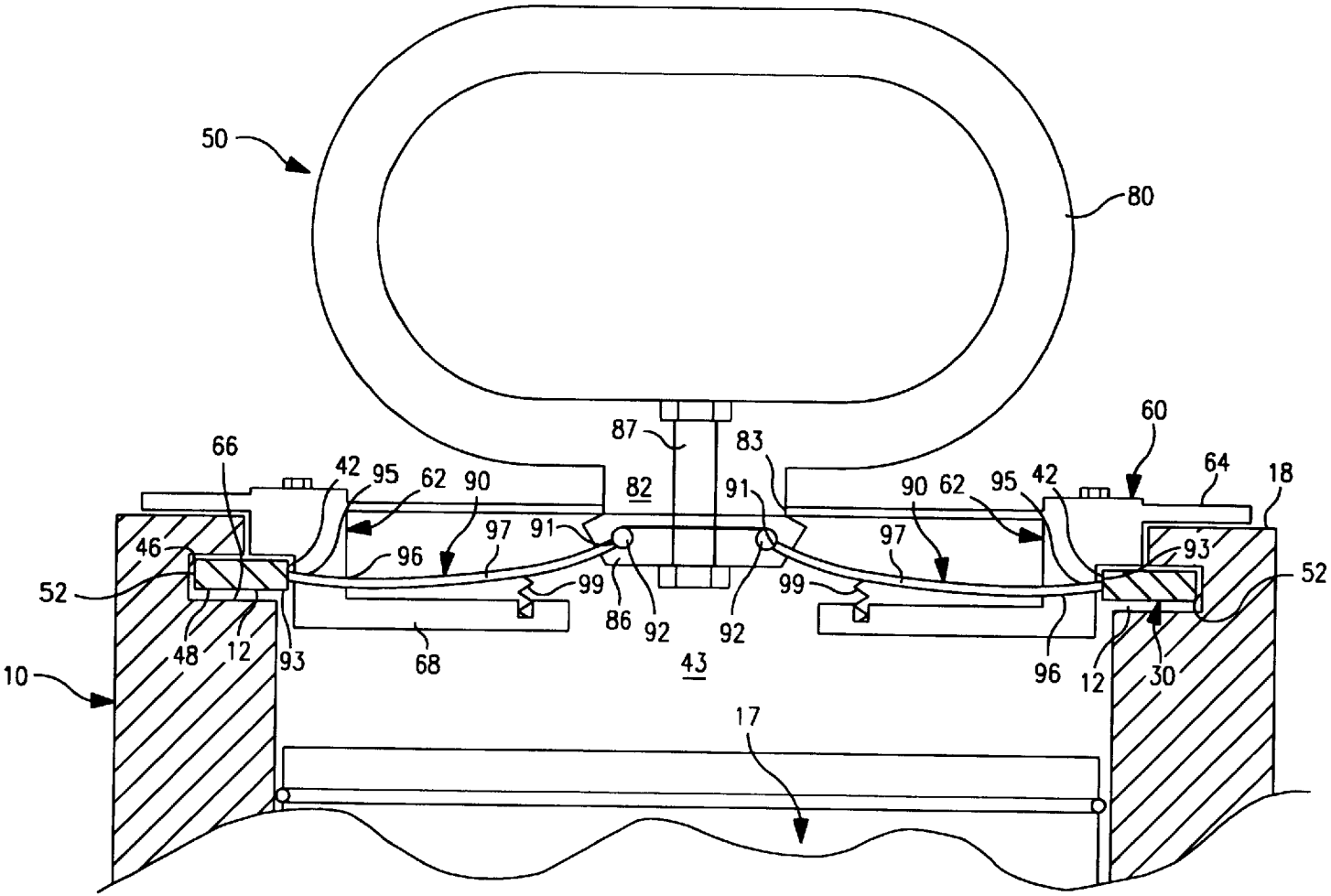
FIG. 3 is an enlarged side elevation of the hydraulic cylinder of FIG. 1 with the snap ring of FIG. 2 being seated within the internal annular groove by using a tool configured in accordance with the principles of the present invention.

Referring now to FIG. 4, there is shown a tool 50 configured in accordance with the principles of the present invention. The tool 50 is both an installation tool and a quality control tool which ensures that the snap ring 30 is properly seated within the interior annular groove 12. While the band 31 of the snap ring 30 has a natural bias which causes it to expand until the outer periphery 44 of the ring abuts the bottom 52 of the groove 12, the band 31 on occasion tends to twist and bind with the surfaces 13 and 14 of the groove preventing the band from properly seating in the groove. By using the tool 50, the concern that snap ring 30 may not be adequately slated is addressed.

The tool 50 includes a support frame 60 comprised of a rim portion 62 and an end flange 64. The end flange 64 abuts the end face 18 of the hydraulic cylinder 10, while the rim 62 projects down into the bore of the hydraulic cylinder. The rim 62 has an annular shoulder 66 which abuts the first surface 46 of the snap ring 30, while a relatively small diameter, annular projecting portion 68 extends within the area 43 enclosed by the inner periphery 42 of the snap ring. A loop handle 80 has a shank portion 82 projecting therefrom through an opening 83 in the flange 64, while a hub 86 abuts the shank 82 and is held thereagainst by an assembly bolt 87.

A hub 86 provides a coupling which couples a plurality of angularly projecting spokes 90 extending therefrom to the handle 80. Each of the spokes 90 has an inner end 91 which is attached to the hub 86 by an anchor 92 and an outer end 93 which engages the inner periphery 42 of the snap ring 30 when the annular projecting portion 68 of the rim 62 extends into the snap ring. The spokes 90 are somewhat flexible and are restrained along outer finger portions 95 thereof by apertures 96 extending through the projecting portion 68 of the hub 62. Each of the spokes 90 further has an inner end portion 97 which is slightly bowed outwardly toward the hub 86. A return spring in the form of a coil spring 99 engages the bottom surfaces of each of the spokes 90 to bias the spokes and thus the handle 50 outwardly away from the support frame 60.

In operation, the tool 50 is axially aligned with the bore of the hydraulic cylinder 10 and is pressed home into the cylinder in an axial direction. The shoulder 66 on the hub 62 engages the top surface 46 on the snap ring 30 and presses the snap ring 30 against the shoulder 13 within the cylinder 10. This tends to flatten the snap ring 30 so that it is more precisely aligned with the inner annular groove 12. On further pressing, the handle 80 presses the hub 86 to push against the inner ends 91 of the spokes 90 and forces the outer ends 93 of the finger portions 95 against the inner periphery 42 of the snap ring 30. This provides an axial force which shoves the snap ring 30 to expand radially so as to seat firmly within the annular groove 12 and preferably engage the bottom 52 of the groove 12. The handle 50 is then pulled outwardly in an axial direction to radially retract the spokes 90 from engagement with the inner periphery 42 of the snap ring so as and to withdraw the rim 62 from within the bore of the hydraulic cylinder 10.

The tool 50 thus serves as both an insertion tool and a quality control tool, so that when the hydraulic cylinder 10 has the piston 17 installed therein, the inside surface 48 of the ring 30 provides an internal stop for the piston which is precisely seated in the groove 12.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. An assembly tool for ensuring the proper placement of a snap ring in an annular groove in a cylinder wall, wherein the snap ring has an inner periphery, an outer periphery, a first radial surface and a second radial surface, the tool comprising:

a hub having rim with a step therein defining a radially extending shoulder and an axially projecting portion, wherein the radially extending shoulder is adapted to engage the first radial surface of the snap ring and the axially projecting portion is adapted to seat within the snap ring adjacent the inner periphery thereof;

a plurality of radially projecting fingers extending through the axially projecting portion of the rim, the fingers having outer portions;

a handle for urging the fingers radially outwardly with respect to the hub for causing the outer portions to engage the inner periphery of the snap ring to urge the snap ring to seat within the inner annular groove of the cylinder.

2. The tool of claim 1, further including a spring for urging the handle axially outward with respect to the rim, whereby the fingers are normally biased out of contact with the inner periphery of the snap ring.

3. The tool of claim 2, further including a flange extending radially from the rim and adapted to engage an end of the cylinder wall proximate but spaced from the annular groove.

4. The tool of claim 3, wherein the fingers form portions of radially extending spokes which have one end seated within a coupling element of the handle.

5. The tool of claim 4, wherein the handle includes a grip which is in the form of a loop for facilitating pressing the handle against the bias of the spring and for facilitating pulling the tool out of the snap ring and cylindrical wall.

6. The tool of claim 5, wherein the tool is configured and dimensioned for use with a hydraulic cylinder in which the snap ring is used as a stop for a piston.

7. The tool of claim 2, wherein the handle includes a grip which is in the form of a loop for facilitating pressing the handle against the bias of the spring and for facilitating pulling the tool out of the snap ring and cylindrical wall.

8. The tool of claim 1, wherein the tool is configured and dimensioned for use with a hydraulic cylinder in which the snap ring is used as a stop for a piston.

* * * * *